US009700468B2

(12) United States Patent
Pilotto

(10) Patent No.: US 9,700,468 B2
(45) Date of Patent: Jul. 11, 2017

(54) WHEELCHAIR HAND RIM, COVER AND FASTENING SYSTEM THEREFOR

(71) Applicant: BBRAVER INNOVATION PRODUCTS INC., Sainte-Anne-de-Beaupre (CA)

(72) Inventor: Marco Pilotto, Sainte-Anne-de-Beaupre (CA)

(73) Assignee: BBRAVER INNOVATION PRODUCTS INC., Sainte-Anne-de-Beaupre, QC (CA)

( * ) Notice: Subject to any disclaimer, the term of this patent is extended or adjusted under 35 U.S.C. 154(b) by 381 days.

(21) Appl. No.: 14/347,952

(22) PCT Filed: Nov. 6, 2013

(86) PCT No.: PCT/CA2013/050846
§ 371 (c)(1),
(2) Date: Mar. 27, 2014

(87) PCT Pub. No.: WO2014/071516
PCT Pub. Date: May 15, 2014

(65) Prior Publication Data

US 2016/0000618 A1 Jan. 7, 2016

Related U.S. Application Data

(60) Provisional application No. 61/722,971, filed on Nov. 6, 2012.

(51) Int. Cl.
*A61G 5/02* (2006.01)
*A61G 5/10* (2006.01)

(52) U.S. Cl.
CPC ..... *A61G 5/026* (2013.01); *A61G 5/022* (2013.01); *A61G 5/028* (2013.01); *A61G 5/10* (2013.01)

(58) Field of Classification Search
CPC ..... A61G 5/028; A61G 5/027; A61G 5/02; A61G 2005/1054; A63B 49/08; G05G 1/06; G05G 1/10
(Continued)

(56) References Cited

U.S. PATENT DOCUMENTS 5,927,739 A * 7/1999 Evling ..... A61G 5/02 280/250.1
6,120,047 A 9/2000 Axelson et al.
(Continued)

FOREIGN PATENT DOCUMENTS

DE 4127912 * 2/1993 ..... B25G 1/10
WO 2004/006822 * 1/2004 ..... A61G 5/02
WO 2005120419 12/2005

OTHER PUBLICATIONS

PCT International Search Report, Jan. 15, 2014, 4 pages, PCT/CA2013/050846.
(Continued)

*Primary Examiner* — Anne Marie Boehler
(74) *Attorney, Agent, or Firm* — SmithAmundsen LLC; Stephen L. Farris; Douglas G Gallagher

(57) ABSTRACT

A hand rim or push rim for a wheelchair wheel. The hand rim includes a rim structure with a convex bearing surface on a circumference of the rim structure, wherein the convex bearing surface is off-centered with respect to a center of the rim and tilted in an outer direction with respect to the wheelchair. Also provided is a wheelchair wheel hand rim cover, wherein the cover is made of ethylene vinyl acetate. There is also provided a fastening system for fastening a hand rim to a wheel. The fastening system includes fixing elements selectively and slideably interfacing with a plurality of anchor elements for selectively setting a separation distance between the hand rim and the wheel.

9 Claims, 11 Drawing Sheets

(58) Field of Classification Search
USPC ..... 280/250.1, 304.1; 74/558
See application file for complete search history.

(56) References Cited

U.S. PATENT DOCUMENTS

| | | | | |
|---|---|---|---|---|
| 6,241,268 | B1 | 6/2001 | Niklasson | |
| 2004/0103745 | A1* | 6/2004 | Willems | A61G 5/02 74/552 |
| 2005/0268744 | A1* | 12/2005 | Embach | B62D 1/06 74/551.9 |
| 2010/0186142 | A1* | 7/2010 | Kume | A41D 19/01564 2/161.1 |
| 2012/0297923 | A1 | 11/2012 | Richter | |
| 2014/0137352 | A1* | 5/2014 | Golla | A47K 7/028 15/160 |

OTHER PUBLICATIONS

PCT Written Opinion of the International Searching Authority, Jan. 24, 2014, 6 pages, PCT/CA2013/050846.

* cited by examiner

WHEELCHAIR HAND RIM, COVER AND FASTENING SYSTEM THEREFOR

CROSS-REFERENCE TO RELATED APPLICATIONS

This application is a nonprovisional National Stage of International Application No. PCT/CA2013/050846, titled WHEELCHAIR HAND RIM, COVER AND FASTENING SYSTEM THEREFOR, filed Nov. 6, 2013, which claims priority to U.S. Provisional Application No. 61/722,971, filed Nov. 6, 2012.

FIELD OF THE INVENTION

The present invention generally relates to wheelchairs. The present invention more specifically relates to a hand rim or a push rim for a wheelchair, as well as a cover and a fastening system for the hand rim.

BACKGROUND OF THE INVENTION

Hand rims on wheelchairs are used for propelling and maneuvering the wheelchair. Certain prior art systems have been developed to address disadvantages of standard hand rim designs.

U.S. Pat. No. 4,366,964 discloses a wheel chair hand rim that claims to provide improved control and mobility through a cross-sectional contour that is configured to optimize the gripping surface and finger wrap over widely differing angles.

U.S. Pat. No. 5,927,739 discloses a dual friction hand rim assembly that can have a rubber-like traction ring providing a propulsion rim portion to propel the wheelchair and that can have a smooth metal rim, brake or braking rim portion to restrain and brake the wheelchair without burning or otherwise injuring the user's hand.

U.S. Pat. No. 7,497,456 discloses a wheelchair pushrim with an increased surface area and an insert between the wheel and the pushrim. The cross-section of the pushrim is an elongated circle and the insert is a concave trough made of an elastic material which compressibly fits between the wheel and the rim for convenient installation.

However, there is still a need for a hand rim for a wheelchair which provides improved maneuvering performance through its shape and through a cover on the rim, as well as easy customization of the spacing between the rim and the wheel.

SUMMARY OF THE INVENTION

An object of the present invention is to propose a hand rim that satisfies at least one of the above-mentioned needs.

According to the present invention, that object is accomplished with a hand rim for a wheelchair wheel, said hand rim comprising a rim structure, said rim structure comprising a convex bearing surface on a circumference of the rim structure, wherein the convex bearing surface is off-centered with respect to a center of the rim and tilted in an outer direction with respect to the wheelchair.

According to the present invention, there is also provided a wheelchair wheel hand rim cover, wherein the cover is made of ethylene vinyl acetate.

According to the present invention, there is also provided a fastening system for fastening a hand rim to a wheel, the fastening system comprising fixing elements selectively and slideably interfacing with a plurality of anchor elements for selectively setting a separation distance between the hand rim and the wheel.

According to the present invention, there is also provided a hand rim that can be used with the above-described rim cover and fastening system.

A non-restrictive description of a preferred embodiment of the invention will now be given with reference to the appended drawings.

PREFERRED EMBODIMENTS OF THE PRESENT INVENTION

Referring to FIGS. 1 to 5, a hand rim 10 for a wheelchair wheel 12 is provided. In the following text, the expression "hand rim" can also be interpreted as being a "push rim". The hand rim 10 includes a rim structure 14 with a convex bearing surface 16 on a circumference of the rim structure 14, wherein the convex bearing surface 16 is off-centered with respect to a center of the rim and tilted in an outer direction with respect to the wheelchair.

The shape of the hand rim is such that it features an ergonomic design developed specifically to better adapt to a user's hands, particularly paraplegic and tetraplegic users.

The rim's cross-section is ovoid rather than cylindrical as is the case for most hand rims. This shape was chosen to match as much as possible the morphology of a user's hands or assistance prosthetic to maximize push force while providing greater comfort.

Preferably, the wheelchair user's hands rest on the upper part of the rim, which has a multi-spoke ovoid shape and whose cross-section may feature a flat portion or straight line. The cylinder may be stretched down on a vertical or quasi vertical axis, creating an off-centre bearing surface compared to the centre of the rim and slightly tilted to the outside of the rim.

This lateralized ovoid shape means that the pair of rims comprises a left side and a right side, providing better overall grip and a more comfortable position for the user's hands, wrists, arms and shoulders. The ovoid shape also fosters a continuous push movement, and the more ergonomic grip facilitates braking and deceleration. The handrim helps users drive the wheelchair much better, enhancing their safety.

Figure 3:
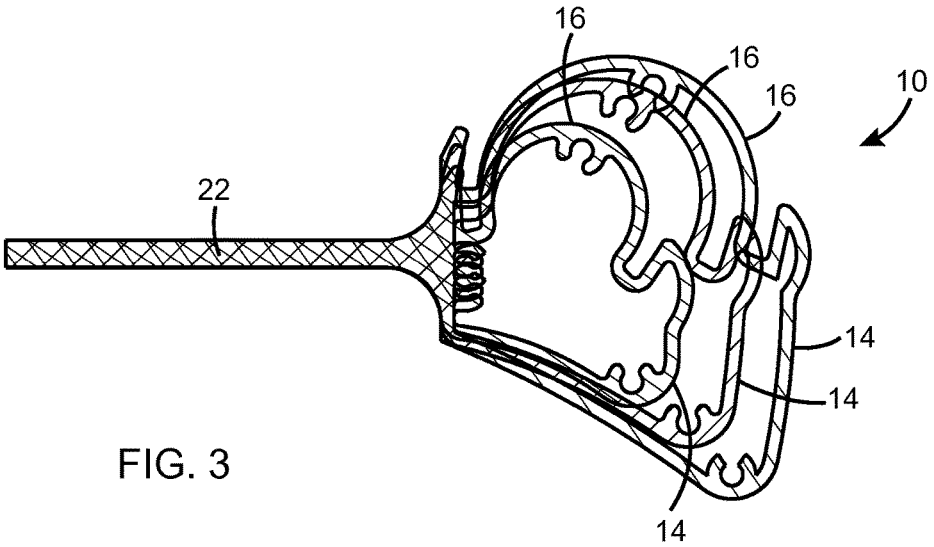
FIG. 3 is a side cross-sectional view of a plurality of differently-sized hand rim structures according to other embodiments of the present invention.

Preferably, as better shown in FIG. 3, the rim cross-section is available in three (3) "diameters" identified in millimeters and in inches (19 mm/0.75 in., 24 mm/0.94 in. and 28 mm/1.10 in.) and in sizes (Small, Medium and Large, respectively). The dimensions actually correspond to the widest or semi-circular section of the ovoid rim, a measurement that refers users to the usual diameters of the cylindrical tubes on classic rims.

Preferably, the bearing surface features a convex structure all around that is designed to accommodate the cover. This cover has a dual purpose:

Increasing user comfort and grip; and

Personalizing the wheelchair

Preferably, the convex structure is delineated by two edges used to insert and hold the cover in place as well as to protect it. The outer edge on the rim is raised and rounded to minimize wear of the cover and to guide the user's hands. The dimensions and position of the slot and its edges on the rim are designed to optimize the cover's installation and protection.

Preferably, the rim is available in six (6) diameters identified in inches and centimeters (18 in./40 cm, 20 in./45.1 cm, 22 in./48.9 cm, 24 in./54 cm, 25 in./56.5 cm, 26 in./59 cm), corresponding to the rim diameters currently recognized as market standards.

Preferably, six (6) mounting brackets 22 can be used to fasten the hand rim 14 to the wheel rim 12 and are produced in the same extrusion or shaping process used to produce the hand rim 14. Using this monocoque method, the mounting brackets 22 are cut out after the extrusion process, thereby eliminating the need for any additional welding, gluing or riveting. This unique manufacturing process simplifies the manufacturing and assembly of the hand rim's components.

Figure 6A:
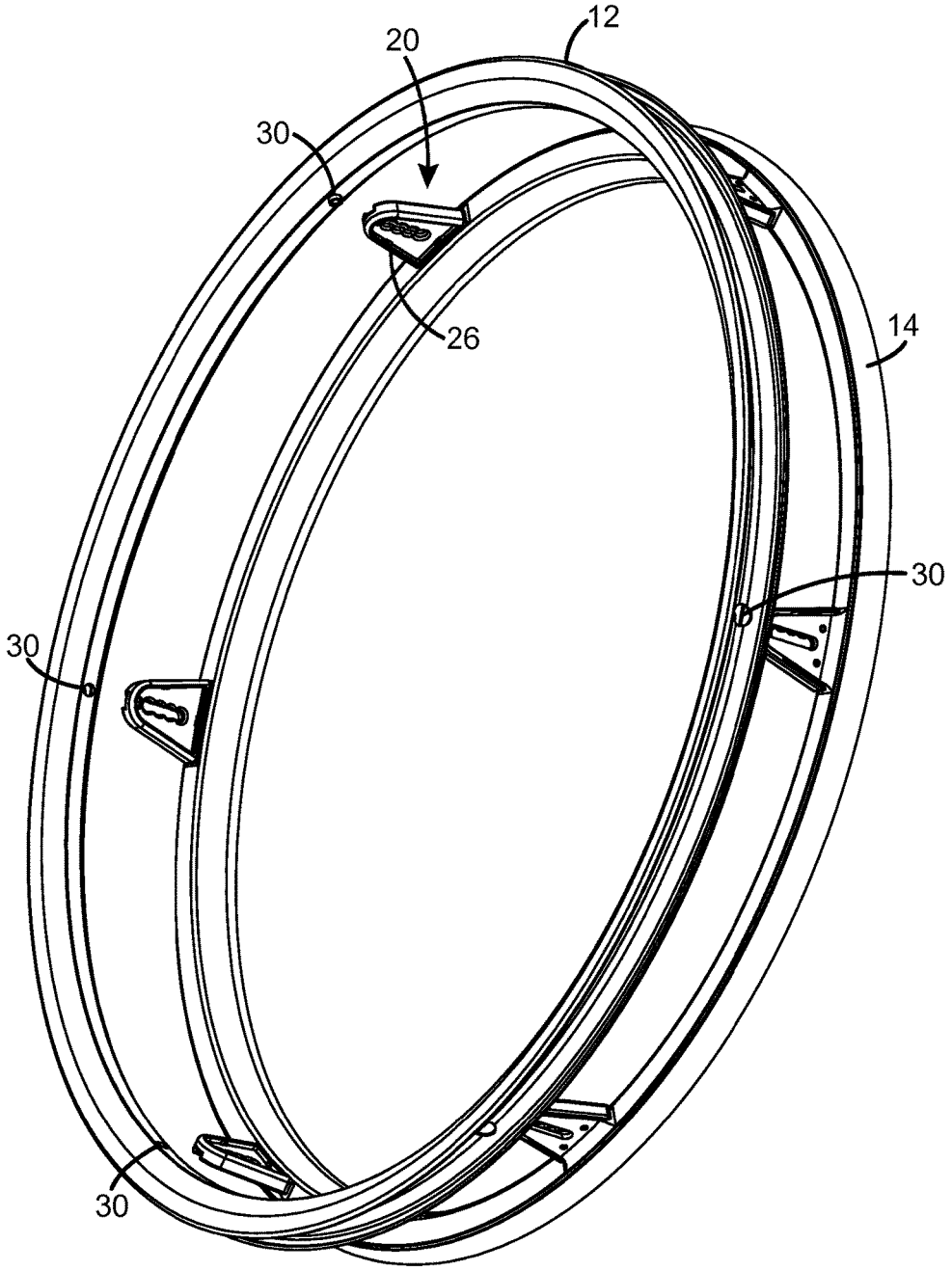
FIGS. 6*a* to 6F are perspective views illustrating an assembly of a hand rim onto a wheelchair wheel according to an embodiment of the present invention.
Figure 6B:
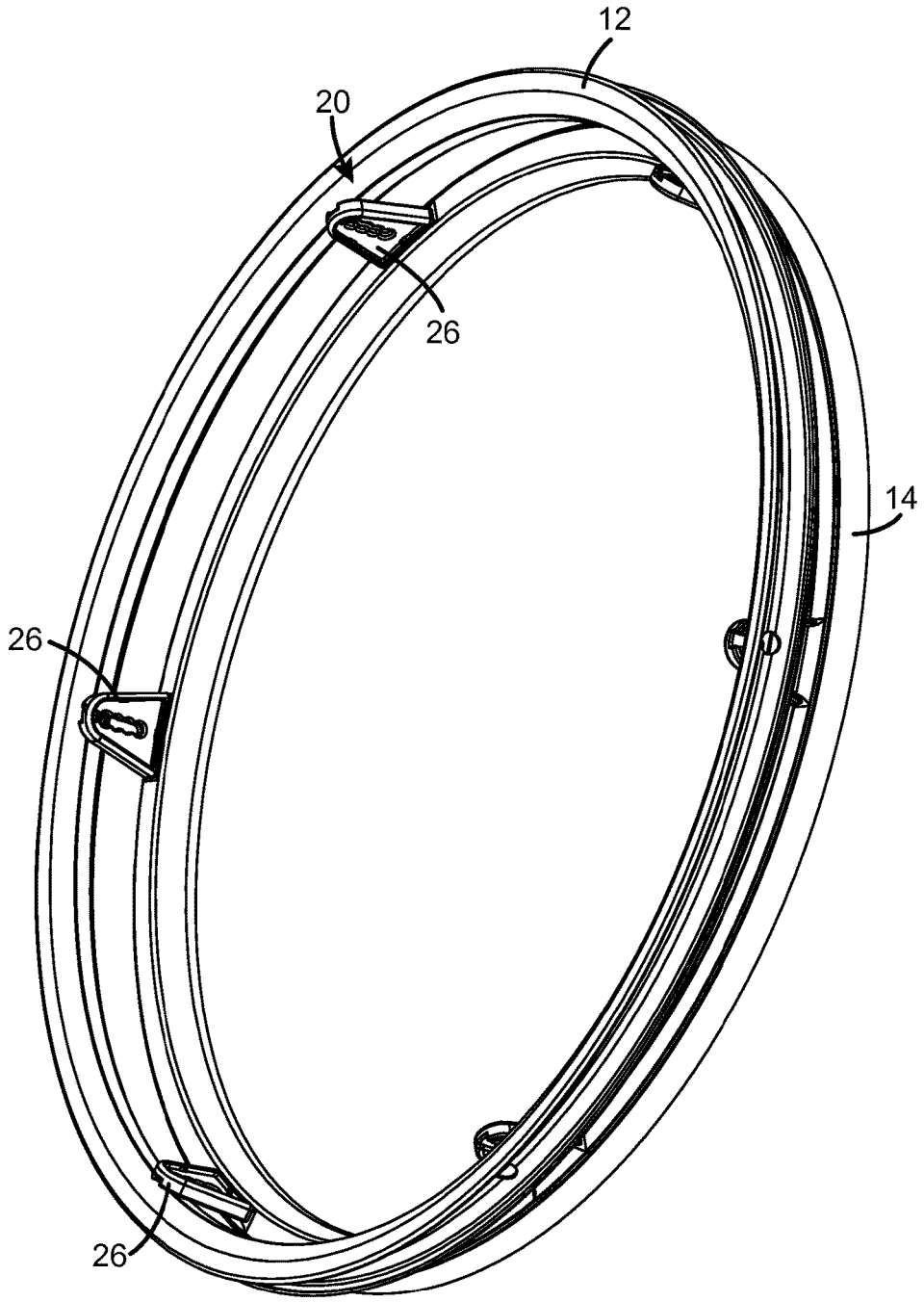
Figure 6C:
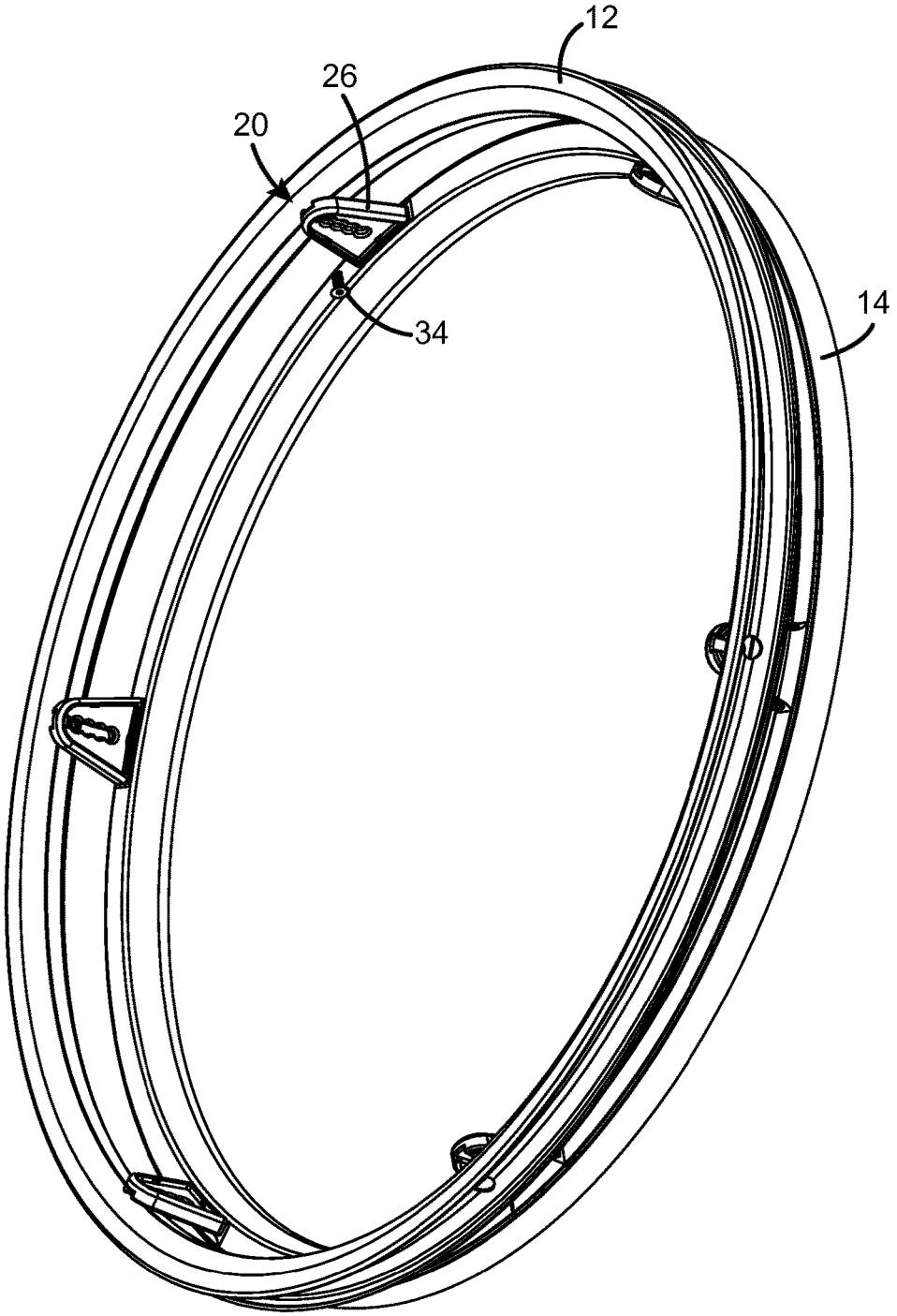
Figure 6D:
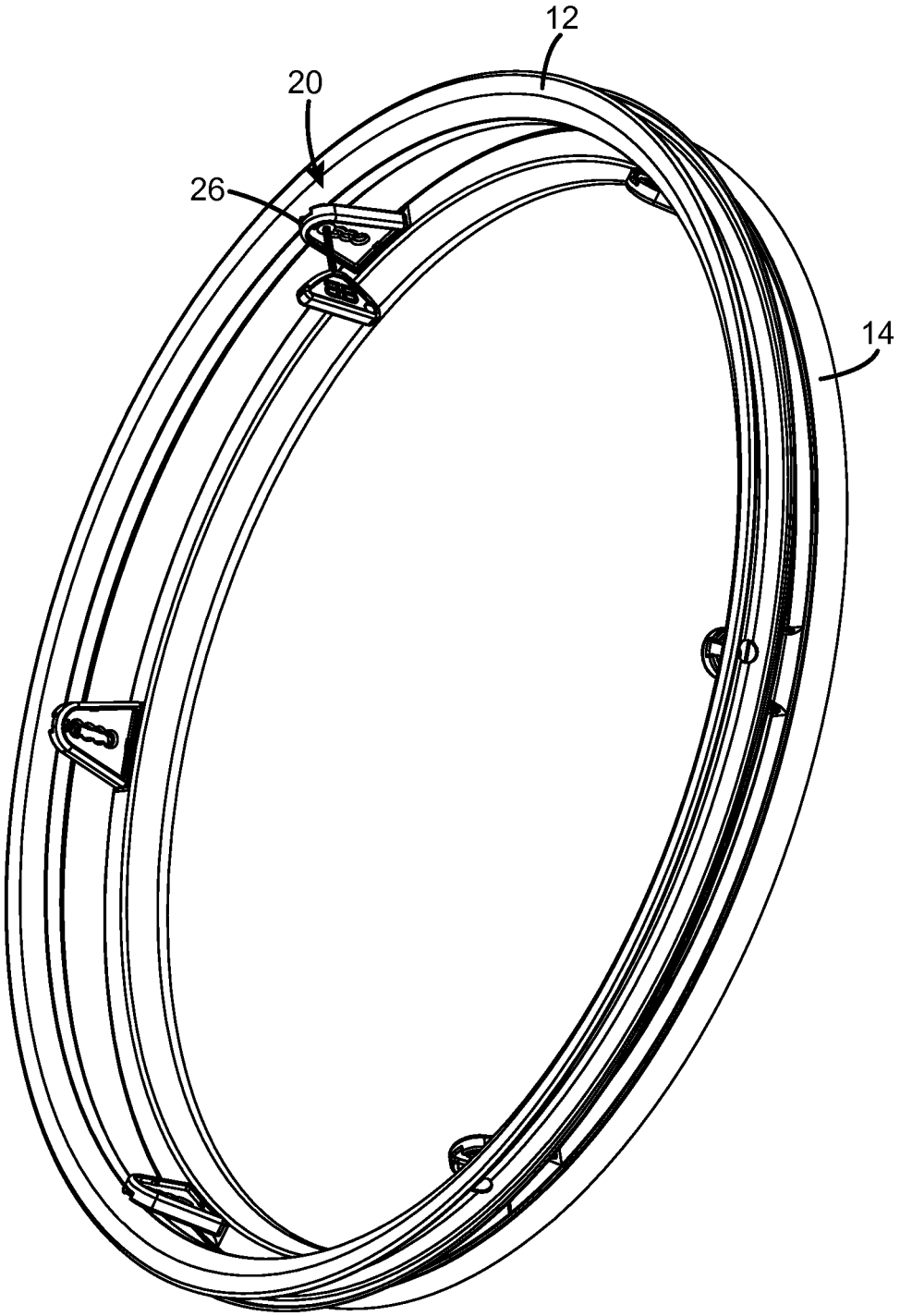
Figure 6E:
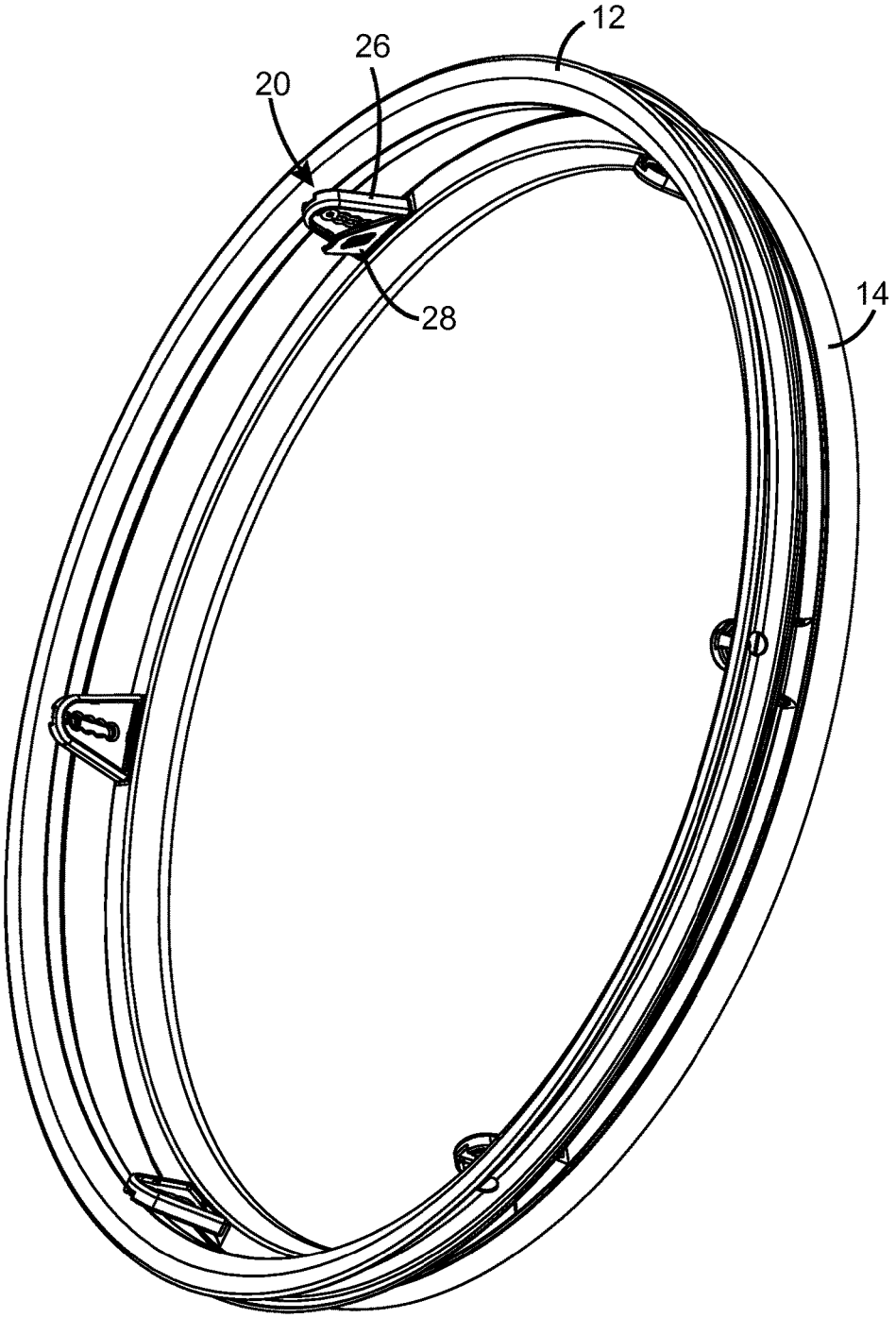
Figure 6F:
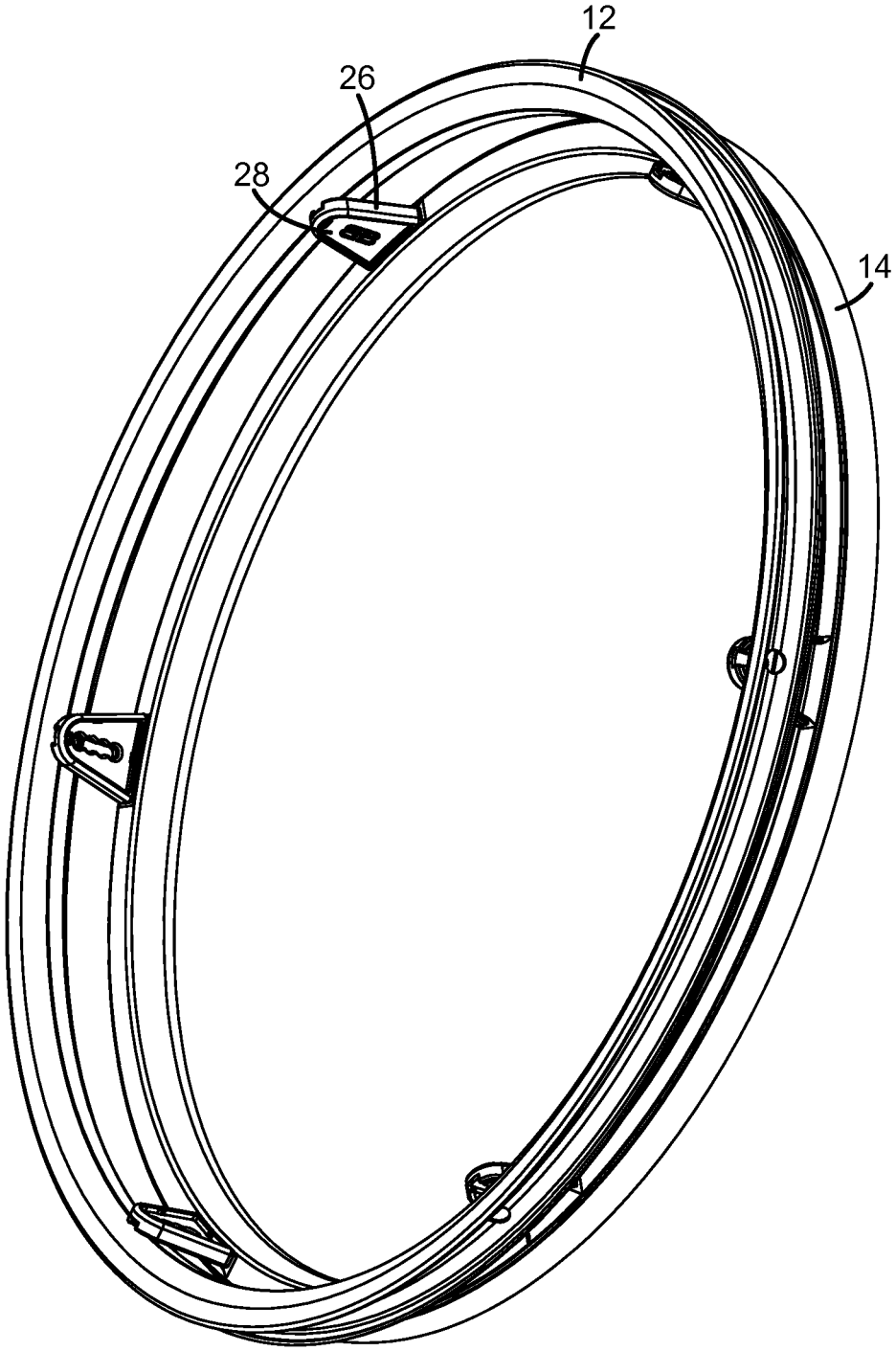

A sample assembly of the rim on a wheel is shown in FIGS. 6A, to 6F. Preferably, as shown in FIG. 6A, the mounting brackets 22 slide on anchor elements, such as metal T-nuts 30, previously inserted in the wheelchair's wheel 12 rims. The mounting bracket sleeves 26 are cast aluminum. The sleeves slide neatly onto the mounting brackets 22 and have four (4) position holes 36 (as better shown in FIG. 7) used to set the spacing and lock the hand rim in place. Each mounting bracket sleeve 26 comes with a polymer protective cap 28 that easily snaps into place.

Preferably, the hand rim 10 is produced by jointing the tube with glue. The joint is then reinforced using three shear dowels inserted in slots provided for this purpose on the tube's inner surface. Gluing rather than welding improves the hand rim's durability and aesthetics.

Preferably, in one embodiment of the invention, the shape and dimensions of this recessed portion are designed to protect the edges of the cover material in the event that the user tilts the wheels to the outside at a 4° angle from the ground.

Preferably, as an optional accessory, an additional part is available to serve as a manual brake block for users having no gripping ability. This is an external device independent from the rim. This formed, machined or moulded piece is the exact negative of the rim's bearing surface (reverse shape of the ovoid cross-section). It is strapped to users' wrists using a Velcro™ or mechanical loop bracelet.

The materials used to manufacture the rim structures are, preferably but not limited to, extruded aluminum. The quality chosen is 6061 T6 aircraft grade aluminum. All other materials with good mechanical properties for the prescribed purpose may be used: wood, plastic, steel, composite, etc. High-performance versions in composite materials such as carbon linen or other laminated, injected or moulded interlining material may be developed after the first commercialized aluminum series. Other materials that may be used for manufacturing the rim structure include: all other metals or metal alloys, such as magnesium or other types of ferrous or non-ferrous metal alloys, not excluding any type or method of resin, plastic or phenolic materials injection.

Preferably, the hand rim may be produced in several colours and available in various finishes: glossy (baked paint, or powder coated), satin (anodization) and matte finish. This way, manual wheelchair users will have access to original and diverse finishes to help them put a personal touch on their "vehicle."

Preferably, as well, limited-series patterns and inscriptions can be applied to the outer portion of the hand rim to give an even more distinctive character to each hand rim user.

Figure 1:
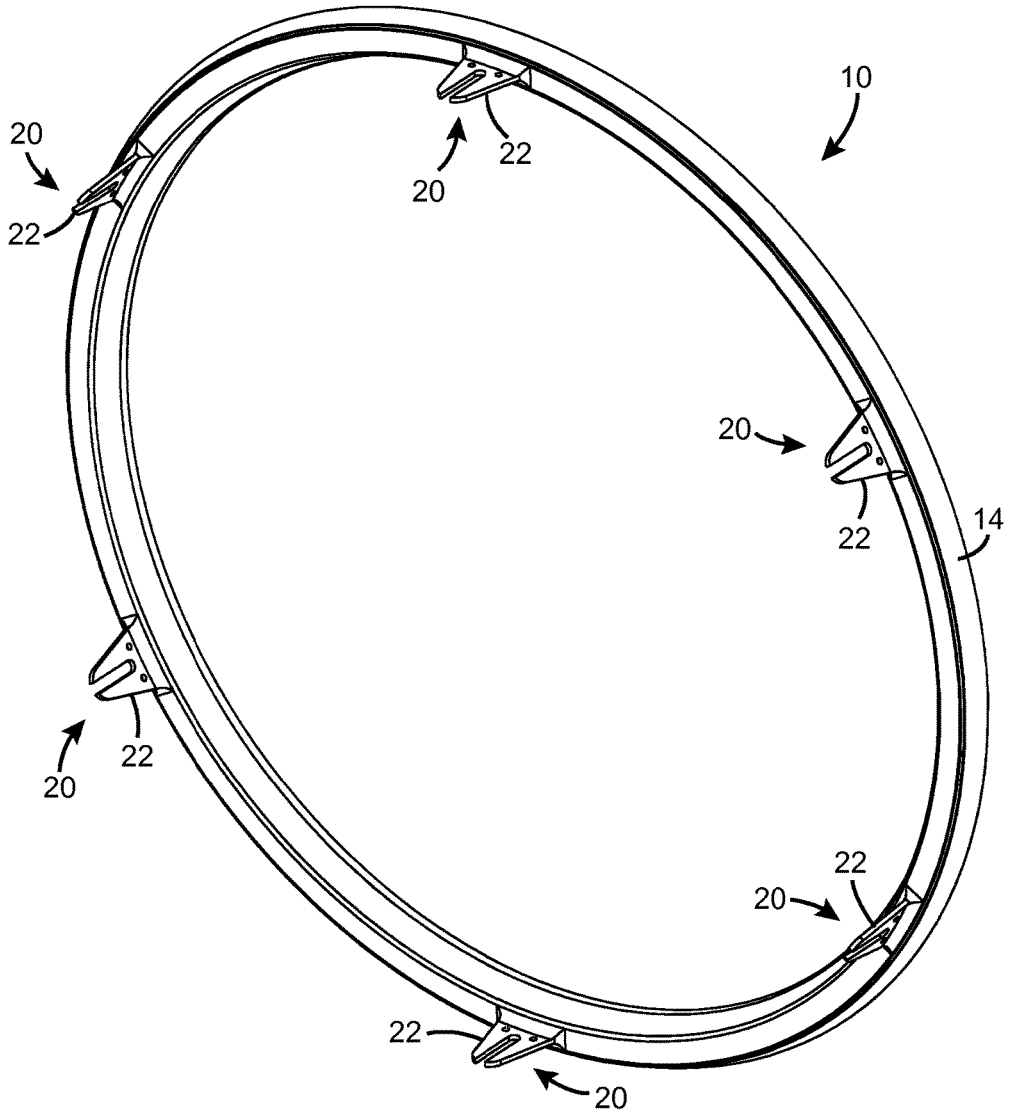
FIG. 1 is a perspective view of a hand rim structure according to a preferred embodiment of the present invention.
Figure 2:
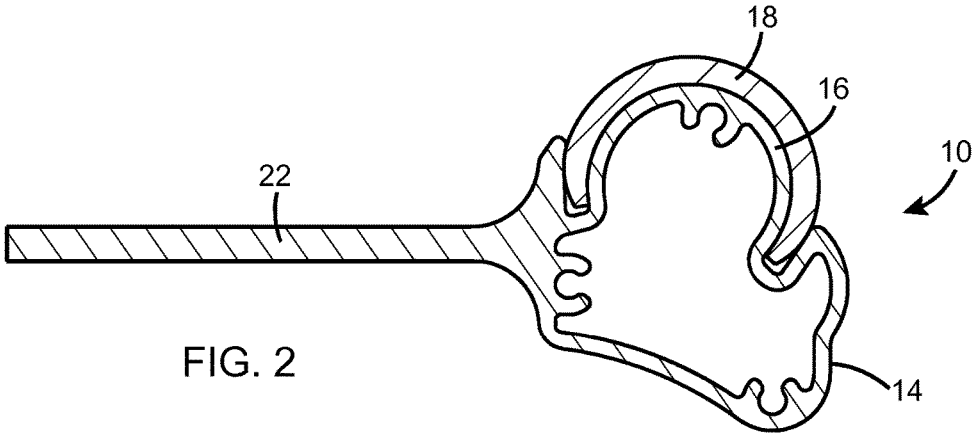
FIG. 2 is a side cross-sectional view of the hand rim structure shown in FIG. 1.
Figure 4:
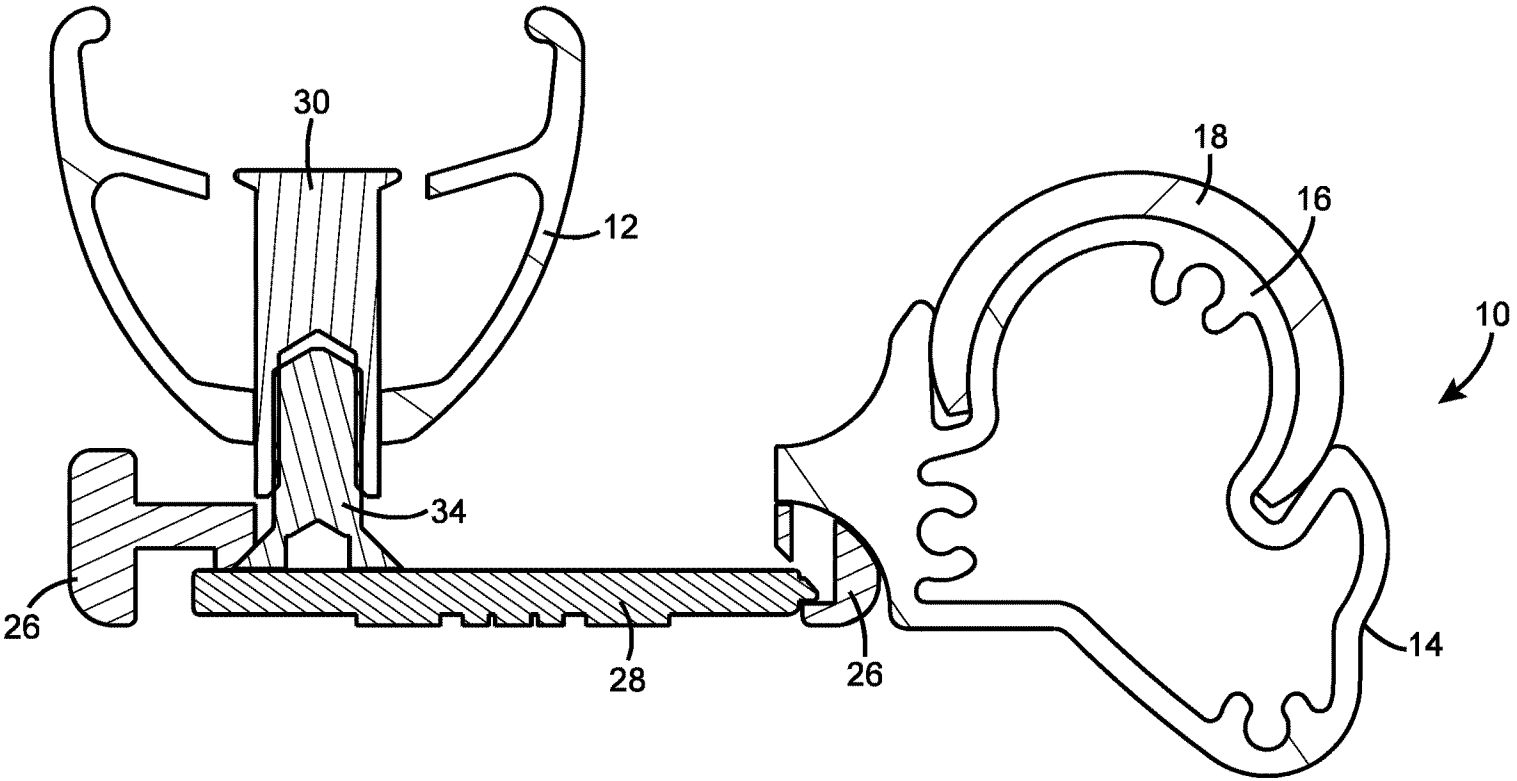
FIG. 4 is a side cross-sectional view of a hand rim linked to a wheelchair wheel according to another preferred embodiment of the present invention.
Figure 5:
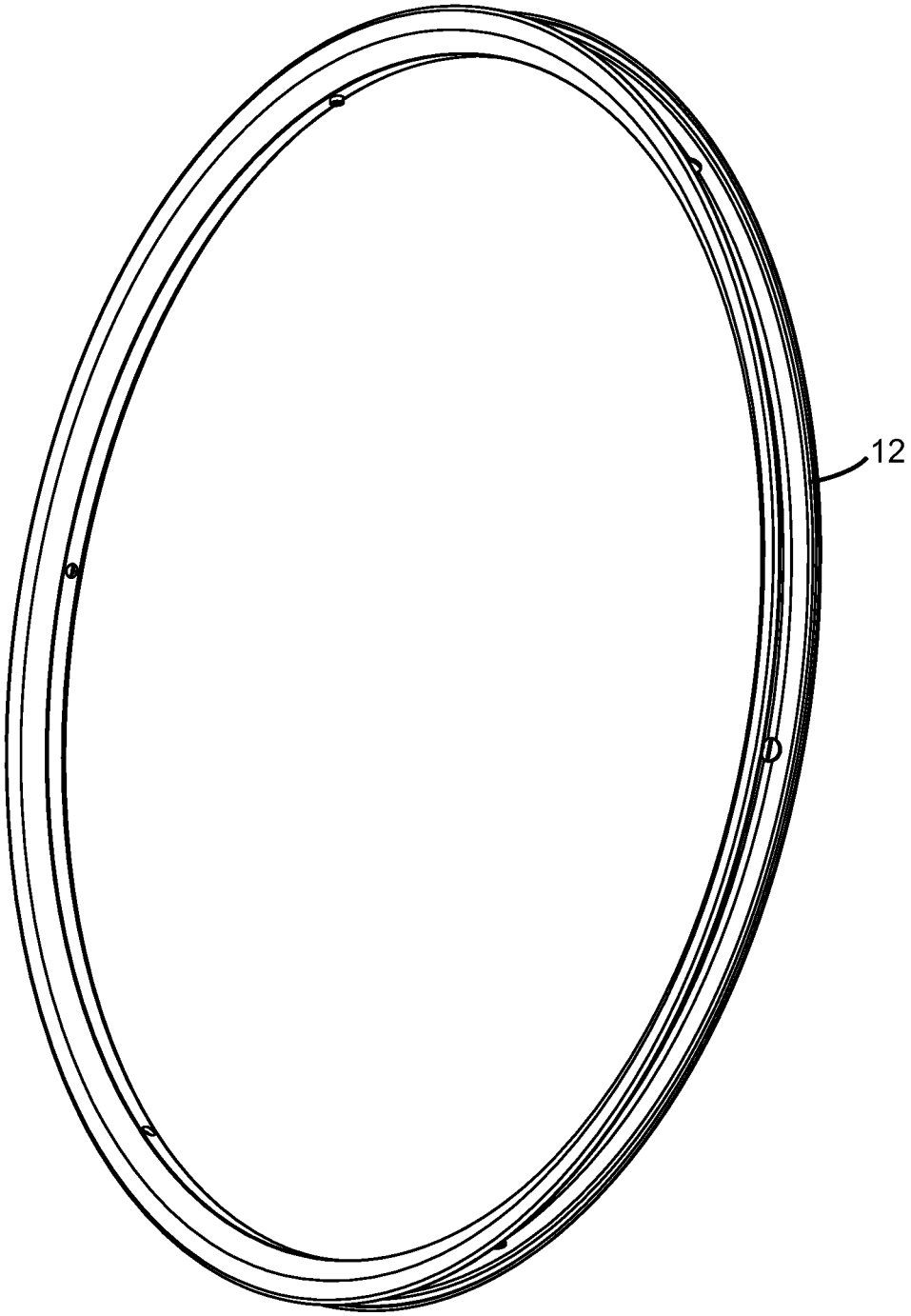
FIG. 5 is a perspective view of a wheelchair wheel according to an embodiment of the present invention.

As better shown in FIG. 2 or 4, an object of the present invention is also to provide a wheelchair wheel hand rim cover 18, wherein the cover 18 is made of ethylene vinyl acetate. The cover provides optimal comfort and better grip, and is available in a wide variety of colours and designs.

Ethylene vinyl acetate (EVA), an elastomer, remains flexible at low temperatures and does not become slippery when in contact with water or other liquids (this latter characteristic is why this material is widely used in water sports equipment). These characteristics are useful for the bearing surface of the hand rim, as it remains comfortable even in cold weather and it continues to provide users with an effective grip in most conditions, for example in the rain or when hands are wet. EVA thus provides a flexible, soft and nonslip bearing surface. In addition, this cover gives users better grip on the hand rim and improves the transmission of a user's push force.

Preferably, the EVA cover may be in various finishes, including a brushed finished and a textured finish using digital die-cutting or thermoforming with a raised pattern, which improves the hand's grip on the rim (similar to steering wheel covers, handlebar grips, etc.).

Ethylene vinyl acetate (EVA) is not used in any wheelchair hand rims known to the Applicant and currently available on the market. The "padded" hand rims currently available typically use vinyl, rubber or injected polyurethane foam. EVA is a material of choice for extended use on a hand rim, because it considerably reduces the risk of injury to hands and the inner wrists, which are in constant contact with the hand rim when propelling the wheelchair. EVA's properties help prevent the formation of calluses on the palms of the hands, a frequent problem resulting from using a manual wheelchair every day (an adult wheelchair user makes and average of 2,400 pushes a day).

Furthermore, unlike bare aluminum or rubber, the ethylene vinyl acetate cover produces no static electricity, completely preventing dirt from accumulating on the surface of the rim and transferring to the user (dirt from the air, ground, contact with various objects and, above all, dirt from the chair's tires). The EVA cover minimizes and can even eliminate the need to wear protective gloves.

Preferably, the EVA used for the hand rim replaces the material used on the covered hand rims available on the market, i.e. vinyl, rubber or injected foam. This cover material is replaceable, either following regular wear or as desired.

Preferably, other open-cell copolymers, elastomers and synthetic rubbers eventually developed by the industry may be used to cover hand rims.

Aesthetics is another reason for using EVA on the hand rim. Because this material can be produced in a variety of colours and exclusive patterns, users can add a special touch to their wheelchairs in an infinite combination of styles. Original inscriptions and graphic designs can also be applied through various processes for personalizing the wheelchair.

Ethylene vinyl acetate (EVA) can also be a preferred material for creating two- or three-dimensional decorative designs. Inscriptions, logos and artistic designs can be applied to this material, as well as a wide range of colours, both on curved and flat surfaces. These designs and colours can be applied on top of or in the material itself, and even on the inner surface in the case of a translucent cover, The base cover can show through the translucent cover and is protected from wear. Multiple application methods and processes can be used to this end: screen printing, heat transfer, sublimation, etc.

Preferably, the ethylene vinyl acetate (EVA) that is used comes in 2- to 3-mm-thick sheets in a variety of colours or transparency. The EVA sheets are cut and assembled using die cutting (or any other cutting process) on a digital cutting table, in the designs and textures selected. The material is cut in a strip of a selected width and applied to the bearing surface cavity using an industrial-strength adhesive, Velcro™ or adhesive tape.

Figure 7:
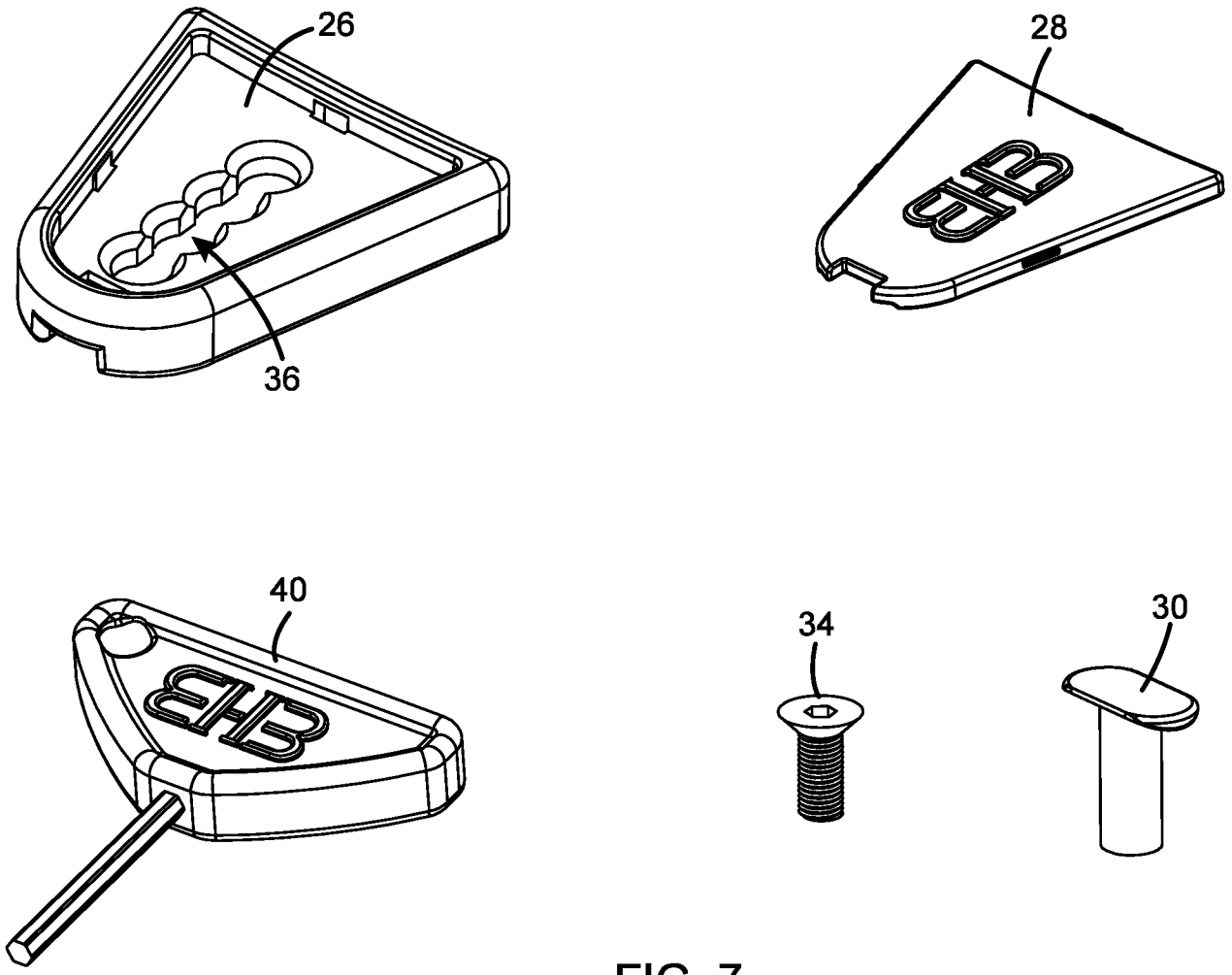
FIG. 7 is a perspective view of components of a fastening system used in the assembly sequence shown in FIGS. 6A to 6F.

As better shown in FIGS. 6A to 6F and as presented above, an object of the present invention is also to provide a fastening system 20 for fastening a hand rim 10 to a wheel 12. The fastening system 20 includes fixing elements selectively and slideably interfacing with a plurality of anchor elements, such as metal T-nuts 30, for selectively setting a separation distance between the hand rim 10 and the wheel 12. Preferably, the fastening system can offer, for example, four spacing options from the wheel and makes it easy to install and uninstall the hand rim without users having to remove the wheels, tires and inner tubes from the chair, using fastening accessories provided with the purchase of a hand rim (for example, as shown in FIG. 7, a screw 34, T-nut 30 and hex head screwdriver set 40). The fastening system can be used to fasten the above-described rim to standard wheels on current manual wheelchair models.

Preferably, the fastening system 20 that fastens the hand rim to the wheel has six screw points or anchor elements, corresponding to the system currently used on standard wheels.

Preferably, the fastening system may offer four spacing options between the hand rim and the wheel (systems currently available on the market typically have only two). This hand rim/wheel adjustment system can alternatively be micro-incremental. This helps users easily find the best position depending on the morphology of their hands and their ability to grip the hand rim.

Preferably, the mounting brackets make it easy to fasten the hand rim to the wheel's screw points by sliding the brackets on the stem of the T-nuts 30 (as shown in FIG. 6B), previously inserted in the wheel rim, to the desired spacing.

Preferably, the mounting bracket sleeve 26 (or other mechanical component) slides onto the mounting bracket 22 to allow passage of a screw 34 (as shown in FIGS. 6C and 6D) to link with the T-nut and thus set the rim spacing as desired and lock the hand rim in place. This mounting bracket sleeve 26 is preferably composed of a cast aluminum (or other material) part featuring four (4) position holes 36 for the retaining screw, making it an essential component for setting the hand rim to the desired position and preventing the screw from loosening.

Preferably, as shown in FIGS. 6E and 6F) a protective cap 28 can be used to cover the top of the mounting bracket sleeve 26. This flat polymer part easily snaps into place. The protective cap 28 covers the screws and protects them from oxidization and other wear or deterioration. The cap 28 also serves an aesthetic purpose as it hides the head of the screw in an original way as the caps can be offered in several colours that can be matched to the colours and designs chosen by the user for the hand rim cover.

Preferably, the designs, materials and processes described above can be used to produce improved and more comfortable manual wheelchair equipment made original by its customizable appearance.

Preferably, a wide selection of designs and colours can be offered such that users can mix and match to style their chair in their own image. Thus, life in a wheelchair can be enhanced through a little aesthetic attention and fantasy, without sacrificing the quality of the equipment.

Preferably, such original aesthetics are available to individuals and groups alike (e.g. wheelchair sports teams) within the community of manual wheelchair users.

Preferably, the above-described components and systems are well suited to the particular clientele of wheelchair users as it provides ease of installation and adjustment of the hand rims.

Preferably, manual wheelchair users are thus provided with an innovative and distinctive product that remains effective in several different operating conditions.

Although preferred embodiments of the present invention have been described in detail herein and illustrated in the accompanying drawings, it is to be understood that the invention is not limited to these precise embodiments and that various changes and modifications may be effected therein without departing from the scope of the present invention.

The invention claimed is:

1. A hand rim for a wheelchair wheel, said hand rim comprising:

a rim structure, said rim structure comprising a convex bearing surface on a circumference of the rim structure, wherein the convex bearing surface is off-centered with respect to a center of the rim and tilted in an outer direction with respect to the wheelchair;

a fastening system for fastening the hand rim to the wheel, the fastening system comprising fixing elements selectively and slideably interfacing with a plurality of anchor elements on the wheel for selectively setting a separation distance between the hand rim and the wheel;

fixing element sleeves slideable over the fixing elements and the anchor elements on the wheel; and protective cap elements removably covering the fixing elements and fasteners fastening the fixing elements to the anchor elements.

2. The hand rim according to claim 1, wherein the convex bearing surface defines a pair of slotted edges for receiving and holding a rim cover.

3. The hand rim according to claim 2, wherein the rim cover is made of ethylene vinyl acetate.

4. The hand rim according to claim 1, wherein the fixing elements are mounting brackets.

5. The hand rim according to claim 4, wherein the mounting brackets are integrally formed with the rim structure.

6. The hand rim according to claim 1, wherein each fixing element sleeve comprises a plurality of offset apertures shaped to receive the anchor elements, each offset aperture defining the separation distance between the hand rim and the wheel.

7. A fastening system for fastening a hand rim to a wheel, the fastening system comprising:

fixing elements selectively and slideably interfacing with a plurality of anchor elements on the wheel for selectively setting a separation distance between the hand rim and the wheel;

fixing element sleeves slideable over the fixing elements and the anchor elements on the wheel; and protective cap elements removably covering the fixing elements and fasteners fastening the fixing elements to the anchor elements.

8. The fastening system according to claim 7, wherein the fixing elements are mounting brackets.

9. The fastening system according to claim 7, wherein each fixing element sleeve comprises a plurality of offset apertures shaped to receive the anchor elements, each offset aperture defining the separation distance between the hand rim and the wheel.

* * * * *